US010146161B2

(12) United States Patent
Tress et al.

(10) Patent No.: US 10,146,161 B2
(45) Date of Patent: Dec. 4, 2018

(54) FIELD ENHANCED SOLID-STATE HEATER ELEMENT USEFUL IN PRINTING APPLICATIONS

(71) Applicant: XEROX CORPORATION, Norwalk, CT (US)

(72) Inventors: Tab A. Tress, Henrietta, NY (US); Brian J. Gillis, Penfield, NY (US); Allen J. Thompson, Sodus, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/445,961

(22) Filed: Feb. 28, 2017

(65) Prior Publication Data

US 2018/0246448 A1 Aug. 30, 2018

(51) Int. Cl.
*G03G 15/20* (2006.01)

(52) U.S. Cl.
CPC ..... *G03G 15/2057* (2013.01)

(58) Field of Classification Search
CPC ..... G03G 15/2057
USPC ..... 399/329
See application file for complete search history.

(56) References Cited

U.S. PATENT DOCUMENTS

| | | | | |
|---|---|---|---|---|
| 6,512,913 | B2 | 1/2003 | Hirst et al. | |
| 6,580,895 | B2 | 6/2003 | Hirst et al. | |
| 6,721,530 | B2 | 4/2004 | Hirst et al. | |
| 6,853,831 | B2 | 2/2005 | Hirst et al. | |
| 7,058,346 | B2 | 6/2006 | Domoto et al. | |
| 8,099,035 | B2 * | 1/2012 | Qi | G03G 15/2057 399/333 |
| 8,213,849 | B2 * | 7/2012 | Domoto | G03G 15/2057 219/619 |
| 8,311,468 | B2 | 11/2012 | Qi et al. | |
| 8,526,836 | B2 * | 9/2013 | Mitsuoka | G03G 15/2039 219/216 |

FOREIGN PATENT DOCUMENTS

JP 2011022575 A * 2/2011 ..... G03G 15/2057

* cited by examiner

*Primary Examiner* — Susan S Lee
(74) *Attorney, Agent, or Firm* — Caesar Rivise, PC

(57) ABSTRACT

An improved fuser includes a heater using a solid-state heater element with high frequency field propagation to provide an effective increase in the energy conduction through the fusing belt allowing increased throughput rates over conventional conduction systems. The system employs a solid-state heater with internal circuitry to drive a high frequency field though the fuser belt to the elastomeric top coat, which is laced with high frequency receptors. The belt is then heated directly on the surface bypassing thermal conduction interfaces and is also simultaneously heated by conduction from the waste energy of the heater element.

18 Claims, 9 Drawing Sheets

FIELD ENHANCED SOLID-STATE HEATER ELEMENT USEFUL IN PRINTING APPLICATIONS

BACKGROUND OF THE INVENTION

This invention relates generally to electrostatographic reproduction machines, and more particularly, to a fuser adapted to use high frequency field propagation providers to induce heating while bypassing thermal conducting interfaces.

In electrostatographic printing, commonly known as xerographic or printing or copying, an important process step is known as "fusing". In the fusing step of the xerographic process, dry marking making material, such as toner, which has been placed in imagewise fashion on an imaging substrate, such as a sheet of paper, is subjected to heat and/or pressure in order to melt the otherwise fuse the toner permanently on the substrate. In this way, durable, non-smudging images are rendered on the substrates.

The most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. Various fuser roll systems include a heated fuser roller and a pressure roller to form a nip through which a receiving substrate can pass. The receiving substrate, before passing through the nip, contains previously deposited toner. The heated fuser roll in combination with the pressure roll acts to melt and press the previously deposited toner onto the receiving substrate. Various belt systems can also act to melt and press toner onto the receiving substrate. In both cases, the fusing of the toner particles generally takes place when the proper combination of heat, pressure, and contact time are provided.

However, due to various sizes in the thermal conducting interfaces, there is a tendency to develop gaps in thermal temperature uniformity across a belt fuser. To address these gaps in thermal uniformity various methods have address the issue by increase the thermal output of the heater. Such methods develop problems in that it may require decreases in throughput or set-point changes which require a large dead time. These process speed limitations with solid heater elements reduce the extendibility to design which require high throughput such as higher than 90 ppm.

BRIEF SUMMARY OF THE INVENTION

Accordingly, an improved fuser is disclosed using a solid-state heater element with high frequency field propagation provides an effective increase in the energy conduction through the fusing belt allowing increased throughput rates over conventional conduction systems. The system employs a solid-state heater with internal circuitry to drive a high frequency field though the fuser belt to the elastomeric top coat, which is laced with high frequency receptors. The belt is then heated directly on the surface bypassing thermal conduction interfaces and is also simultaneously heated by conduction from the waste energy of the heater element.

DETAILED DESCRIPTION OF THE INVENTION

Figure 1:
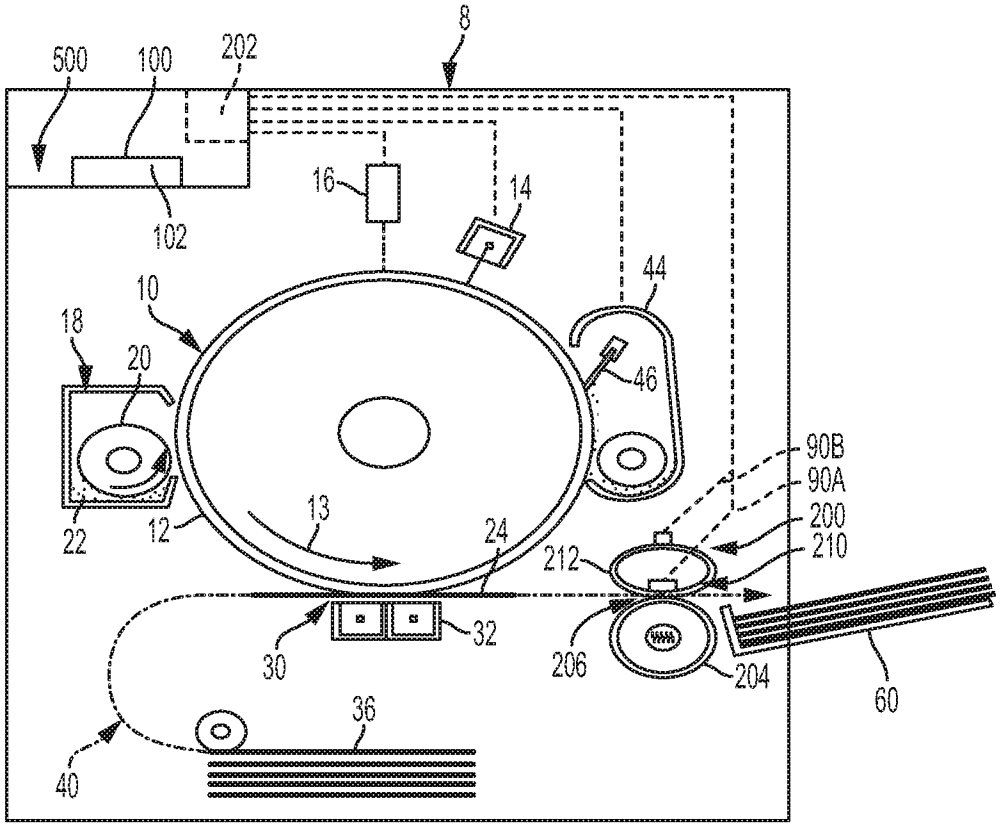
FIG. 1 is an elevational view showing relevant elements of an exemplary toner imaging electrostatographic machine including a first embodiment of the fusing apparatus of the present disclosure.

Illustrative examples of the devices, systems, and methods disclosed herein are provided below. An embodiment of the devices, systems, and methods may include any one or more, and any combination of, the examples described below.

Examples 1 includes a fusing system useful in printing comprising a receptor-laced fusing belt configured to contact an image receiving substrate and fuse marking material deposited on the image receiving substrate, and comprising at least one thermal conduction interface layer and a top layer with a plurality of high frequency receptors; and a solid-state heater element with high frequency field propagation sources positioned in proximity to the at least one thermal conduction interface layer and configured to conduct an electrical current, wherein when the electrical current is applied to one of the high frequency field propagation sources it causes heat to be generated at the top layer by some of the plurality of high frequency receptors.

Example 2 includes Example 1 and wherein the plurality of high frequency receptors are selected from a group consisting of carbon nanotubes, plasmonic particles, or any other electromagnetic absorbent material that can convert the energy into heat.

Examples 3 includes Example 1 and wherein the receptor-laced fusing belt is part of an outer surface of one or more of a fuser roll, a pressure roll, and a donor roll.

Example 4 includes Example 2 and wherein the electrical current is generated from a power source connected to the high frequency field propagation sources.

Example 5 includes Example 4 and wherein the high frequency field propagation sources comprise electrical coils.

Example 6 includes Example 2 and wherein the carbon nanotubes comprise a sheet of a non-woven carbon nanotube textile.

Example 7 includes the system of Example 6 and wherein the sheet of the non-woven carbon nanotube textile comprises one or more of a single-, double-, or multi-walled carbon nanotube.

Example 8 includes the system of Example 1 and wherein the high frequency receptors comprise a highly magnetic, highly conductive material.

Example 9 includes Example 1 and wherein residual heat in the solid-state heater element is transferred to the top layer through the at least one thermal conduction interface layer.

Example 10 includes a method for inductively heating a fusing member useful in printing comprising providing a receptor-laced fusing belt configured to contact an image receiving substrate and fuse marking material deposited on the image receiving substrate, and comprising at least one thermal conduction interface layer and a top layer with a plurality of high frequency receptors; providing a solid-state heater element with high frequency field propagation sources positioned in proximity to the at least one thermal conduction interface layer and configured to conduct an electrical current; conducting an electrical current through at least one of the high frequency field propagation sources; inductively heating the top layer with the plurality of high frequency receptors via the electrical current; and moving the heated top layer to fuse marking material deposited on the image receiving substrate.

Example 11 includes at least one machine-readable medium comprising a plurality of instructions, when executed on a computing device, to implement or perform a method such as Example 10.

The consequential benefit of the disclosed embodiments is that energy from the heater element can be directly transferred to the surface via high frequency receptors mixed with the elastomeric top coat of the fuser belt via electromagnetic fields generated within the heater element. Any waste energy produced by the heater is then transferred through the belt via conduction. In this manner two energy transferring vehicles are used to heat the belt surface while producing no unusable waste energy. The directly transferred to the surface via high frequency receptors will lend itself to very high-efficiency, high throughput, and an opportunity to produce color printing at a high throughput.

Although embodiments of the invention are not limited in this regard, discussions utilizing terms such as, for example, "processing," "computing," "calculating," "determining," "applying," "receiving," "establishing," "analyzing," "checking," or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

The term "controller" is used herein generally to describe various apparatus relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The term "image receiving substrate" generally refers to a print media that is usually flexible, sometimes curled, physical sheet of paper, plastic, or other suitable physical print media substrate for images, whether precut or web fed.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

The term "printing device" or "printing system" as used herein refers to a digital copier or printer, scanner, image printing machine, xerographic device, digital production press, document processing system, image reproduction machine, bookmaking machine, facsimile machine, multifunction machine, or the like and can include several marking engines, feed mechanism, scanning assembly as well as other print media processing units, such as paper feeders, finishers, and the like. A printing system can handle sheets, webs, marking materials, and the like. A printing system can place marks on any surface, and the like and is any machine that reads marks on input sheets; or any combination of such machines.

The term "fuser system" or "fusing system" as used herein may be a roll belt, flat surface or other suitable shape used in the fixing of images to a suitable substrate using marking material. It may take the form of a fuser member, a pressure member or a release agent donor member preferably in the form of a cylindrical roll. Typically, the fuser system component is made of a hollow cylindrical metal core, such as copper, aluminum, steel and like, and has an outer layer of the selected cured fluoroelastomer. Alternatively, there may be one or more intermediate layers between the substrate and the outer layer of the cured elastomer if desired. Typical materials having the appropriate thermal and mechanical properties for such layers include silicone elastomers, fluoroelastomers, silicone grafted fluoroelastomers, EPDM and Teflon PFA sleeved rollers. EPDM is ethylene propylene diene terpolymer and PFA is a Teflon copolymer containing tetrafluoroethylene monomer units along with perfluoroalkyl monomer units such as perfluorovinyl ether.

The term "receptor-laced fusing belt", as used herein is a fuser belt with an elastomeric top coat that is laced with high frequency (HF) receptors that when irradiated by an electromagnetic source such as a high frequency field causes heat to be generated. As used herein, the term "laced" refers to extensive entanglement, embedding, impregnating, or comingling of the HF receptors on the top layer of the fusing belt which makes up the fusing system that is useful in printing.

As used herein and unless otherwise specified, the term "high frequency receptors" means a magnetic material formed as particles such as nanostructures that is not particularly limited and may be suitably selected from known magnetic materials according to the purpose. Suitable examples thereof include iron powder, magnetite, and ferrite. Metals in high frequency receptors efficiently generate heat in the presence of electromagnetic radiation. FIG. 1 is an elevational view showing relevant elements of an exemplary toner imaging electrostatographic machine including a first embodiment of the fusing apparatus of the present disclosure.

Referring now to FIG. 1, an electrostatographic or toner-imaging machine 8 is shown. As is well known, a charge receptor or photoreceptor 10 having an imageable surface 12 and rotatable in a direction 13 is uniformly charged by a charging device 14 and imagewise exposed by an exposure device 16 to form an electrostatic latent image on the surface 12. The latent image is thereafter developed by a development apparatus 18 that, for example, includes a developer roll 20 for applying a supply of charged toner particles 22 to such latent image. The developer roll 20 may be of any of various designs, such as, a magnetic brush roll or donor roll, as is familiar in the art. The charged toner particles 22 adhere to appropriately charged areas of the latent image. The surface of the photoreceptor 10 then moves, as shown by the arrow 13, to a transfer zone generally indicated as 30. Simultaneously, a print substrate or print sheet 24 on which a desired image is to be printed is drawn from sheet supply stack 36 and conveyed along sheet path 40 to the transfer zone 30.

At the transfer zone 30, the print sheet 24 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 24. The print sheet 24 is then forwarded to subsequent stations, as is familiar in the art, including the fusing station having a high precision-heating and fusing apparatus 200 of the present disclosure, and then to an output tray 60. Following such transfer of a toner image from the surface 12 to the print sheet 24, any residual toner particles remaining on the surface 12 are removed by a toner image baring surface cleaning apparatus 44 including a cleaning blade 46 for example.

As further shown, the reproduction machine 8 includes a controller or electronic control subsystem (ESS), indicated generally by reference numeral 500 which is preferably a programmable, self-contained, dedicated mini-computer having a central processor unit (CPU) such as processor 520, electronic storage 102 like data storage device 530, and a display or user interface (UI) 100. At UI 100, a user can select one of the pluralities of different predefined sized sheets to be printed onto. The conventional ESS 500, with the help of sensors, a look-up table 202 and connections, can read, capture, prepare and process image data such as pixel counts of toner images being produced and fused. As such, it is the main control system for components and other subsystems of machine 8 including the fusing apparatus 200 of the present disclosure.

Figure 2:
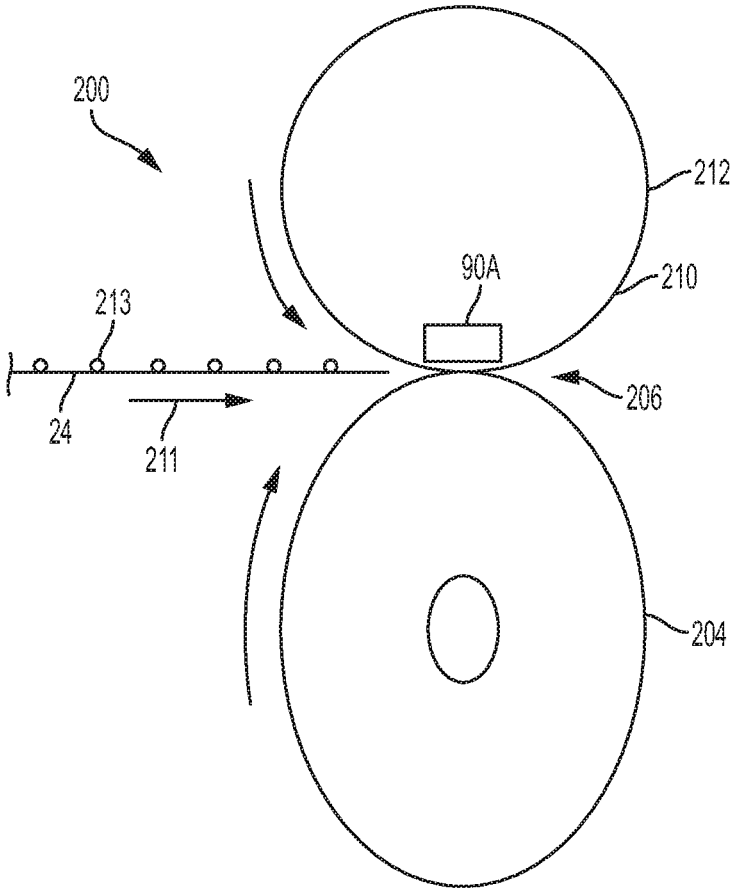
FIG. 2 is an enlarged schematic end view of the fusing apparatus of FIG. 1.

FIG. 2 is an enlarged schematic end view of the fusing apparatus of FIG. 1.

Referring now to FIG. 2, the fusing apparatus 200 of the present disclosure is illustrated in detail and is suitable for uniform and quality heating of unfused toner images 213 in the electrostatographic reproducing machine 8. As illustrated, fusing apparatus 200 includes a rotatable pressure member 204 that is mounted forming a fusing nip 206 with a highly conductive ceramic fuser member show in the form of a roll 212 and a fusing belt 210. Heater 90A is a solid-state heater with internal circuitry to drive a high frequency field though the fuser belt 210 to the elastomeric top coat. Heater 90A is positioned in contact with the inner diameter of fuser belt 210 so as to apply a secondary heat from the wasted energy of heater element 90A. Heater 90B is optional as required by design configuration and is identical in construction to heater 90A. A copy sheet 24 carrying an unfused toner image 213 thereon can thus be fed in the direction of arrow 211 through the fusing nip 206 for high quality fusing.

Figure 3:
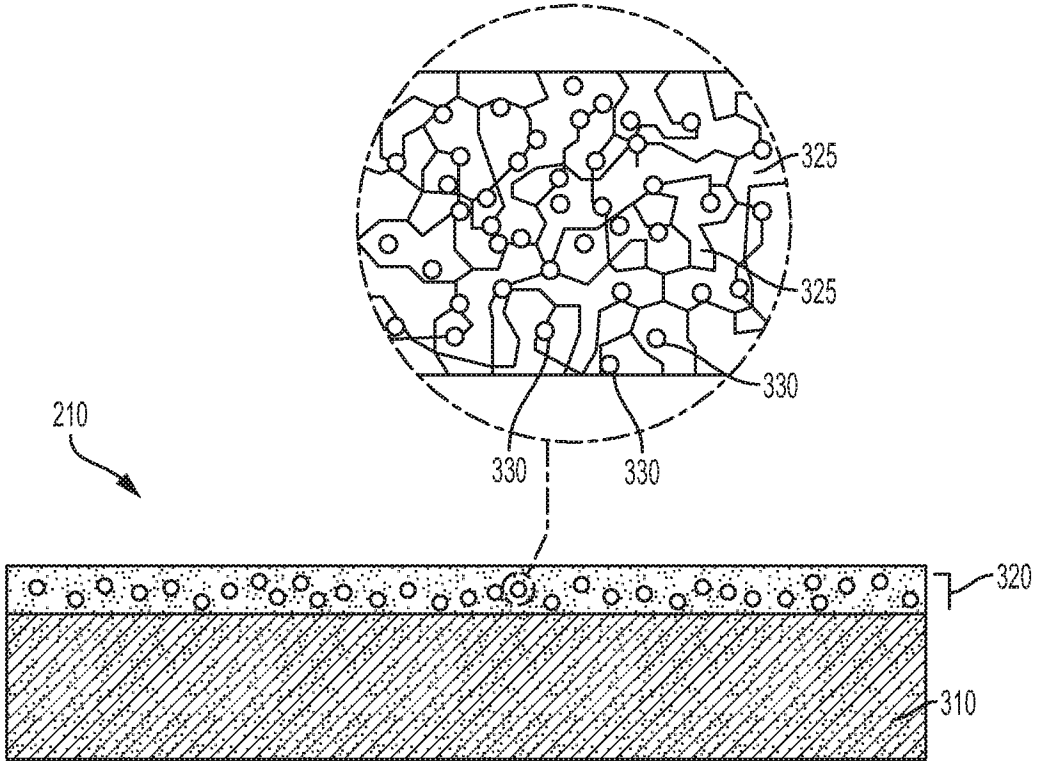
FIG. 3 shows the fusing belt of FIG. 1 that is laced with high frequency receptors in accordance with embodiment.

FIG. 3 shows the fusing belt 210 of FIG. 1 that is laced with high frequency receptors in accordance with embodiment. As shown in FIG. 3, the fusing belt 210 can include a top coat layer 320 comprising an elastomeric top coat laced with high frequency receptors disposed over the substrate 310 which acts as a thermal conduction interface. Because of the receptors the illustrated belt is a receptor-laced fusing belt 210. The top coat layer 320 of the receptor-laced fusing belt 210 is capable of producing eddy current losses and therefore generating heat. It is desired to produce large eddy current losses with little electrical output. The top coat layer 320 includes a plurality of high frequency receptors (particles) 330 substantially uniformly dispersed in one or more cross-linked hyperbranched polymers 325. Energy from heater element 90A can be directly transferred to the top coat via the high frequency receptors 330 mixed with the elastomeric top coat of fusing belt 210 via electro-magnetic fields generated within the heater element 90A. The heat generated by the he high frequency receptors 330 can therefore dissipate heat resulting from an induced eddy current without any physical contact between the top coat layer 320 and the heater element 90A.

Figure 4:
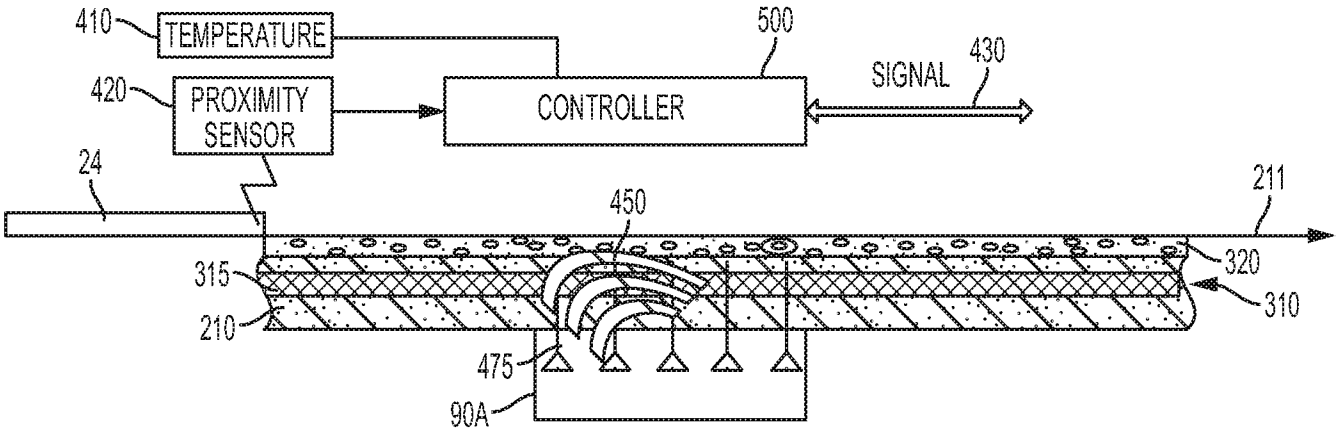
FIG. 4 shows a receptor-laced fusing belt and solid-state heater element with high frequency field propagation in accordance with embodiment.

FIG. 4 shows a receptor-laced fusing belt and solid-state heater element with high frequency field propagation in accordance with embodiment. Unless otherwise noted, elements similar to those previously described have been given the same reference numerals and serve the same functions. As shown fusing 210 comprises the top layer 320 and substrate 310. It is noted that substrate 310 can comprise multiple layers 315 of material. During the printing process a print substrate 24 carrying an unfused toner image thereon is fed in the direction of arrow 211 through the fusing nip 206 for high quality fusing. As the print substrate travels through the fusing nip it is subjected to heat from the top coat layer 320 resulting from a high frequency field 450 that bypasses thermal conduction interfaces (310, 315) and also simultaneously heated by conduction from the residual energy or wasted energy primarily from heater element 90A.

A controller 500 manages the interaction between the heater element 90A and the receptor laced fusing belt by generating a control signal 430. Control signal 430 is generated from inputs received from temperature sensor 410 and proximity sensor 420. Temperature sensor 410 is a thermistor which is disposed inside one of the rollers 204,212 or in location generally around nip 206. Desirably, the temperature sensor 420 may be disposed in the portion where it is expected that the greatest amount of heat will be generated with induction heating. The controller 500 may be used as a safety mechanism in the event of abnormal temperature rise. A proximity sensor configured to sense the absence or presence of an object near the entrance of the dual rolls. Using the proximity sensor 420 the controller 500 can directly heat the part of the receptor-laced fusing belt at the print substrate. For example, the proximity sensor can be a photoelectric sensor configured to sense the absence or presence of an object by using a light transmitter and a photoelectric receiver.

Figure 5:
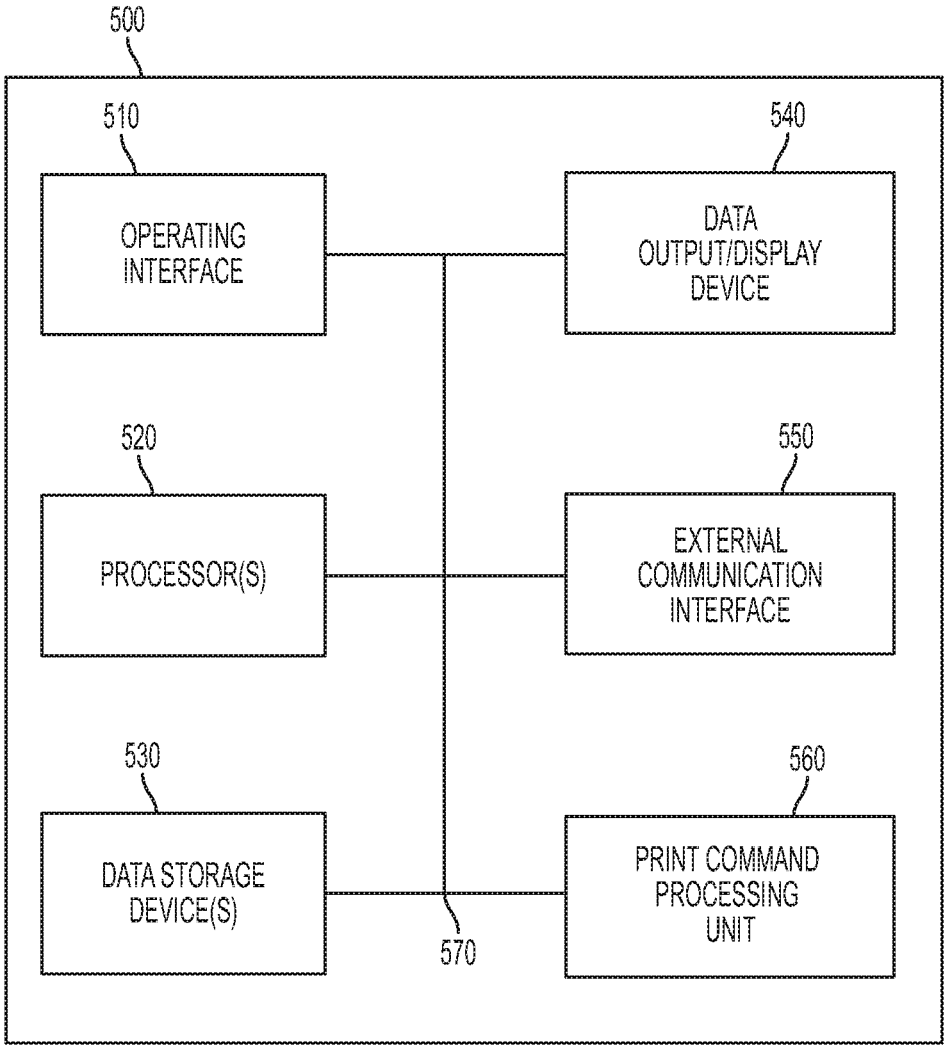
FIG. 5 illustrates a block diagram of an exemplary system for operating an image forming device for selectively bypassing thermal conduction interfaces of a receptor-laced fusing belt in accordance to an embodiment.

FIG. 5 illustrates a block diagram of an exemplary system for operating an image forming device for selectively bypassing thermal conduction interfaces of a receptor-laced fusing belt in accordance to an embodiment. Components of the exemplary system 500 shown in FIG. 5 may be, for example, housed in a user workstation, in a server or in an image forming device.

The exemplary system 500 may include an operating interface 510 by which a user may communicate with the exemplary system 500, or otherwise by which the exemplary system 500 may receive instructions input to it from another source. In instances where the operating interface 510 may be a locally accessible user interface, the operating interface 510 may be configured as one or more conventional mechanisms common to computing and/or image forming devices that permit a user to input information to the exemplary system 500. The operating interface 510 may include, for example, a conventional keyboard and mouse, a touchscreen with "soft" buttons or with various components for use with a compatible stylus, a microphone by which a user may provide oral commands to the exemplary system 500 to be "translated" by a voice recognition program, or other like device by which a user may communicate specific operating instructions to the exemplary system 500.

The exemplary system 500 may include one or more local processors 520 for individually operating the exemplary system 500 and for carrying out processing, assessment, reporting and control functions. Processor(s) 520 may include at least one conventional processor or microprocessor that interprets and executes instructions to direct specific operation and analysis functions with regard to image data that is commanded or intended to direct image forming in a specific image forming device with which the exemplary system 500 is associated.

The exemplary system 500 may include one or more data storage devices 530. Such data storage device(s) 530 may be used to store data or operating programs to be used by the exemplary system 500, and specifically the processor(s) 520, in carrying out the image data forming functions of the exemplary system 500. Data storage device(s) 530 may be used to collect information regarding any or all of the functions of the exemplary system 500, as described above. The data storage device(s) 530 may include a random access memory (RAM) or another type of dynamic storage device that is capable of storing collected information, and separately storing instructions for execution of system operations by, for example, processor(s) 520. Data storage device(s) 530 may also include a read-only memory (ROM), which may include a conventional ROM device or another type of static storage device that stores static information and instructions for processor(s) 520. Further, the data storage device(s) 530 may be integral to the exemplary system 500, or may be provided external to, and in wired or wireless communication with, the exemplary system 500.

The exemplary system 500 may include at least one data output/display device 540, which may be configured as one or more conventional mechanisms that output information to a user, including a display screen on a computing or image forming device, including a graphical user interface (GUI) on the image forming device. The data output/display device 540 may be usable to display to a user an indication of image forming data, and a selection of image receiving media, that may be evaluated to indicate a control function for an airflow and/or processing speed to mitigate adverse effects of excess heat imparted to particular image receiving media substrates associated with particular image forming operations in an image forming device. The data output/display device 340 may then be usable, in conjunction with the operating interface 310 to display to a user a series of options for optimized image forming operations in the image forming device.

The exemplary system 500 may include one or more separate external communication interfaces 550 by which the exemplary system 500 may communicate with components external to the exemplary system 500, or by which the exemplary system 500 may communicate with an image forming device with which the exemplary system 500 may be associated when it is not fully integral to the image forming device. No particular limiting configuration to the external communication interface(s) 550 is to be implied by the depiction in FIG. 5, other than that the external communication interface(s) 550 may be configured to connect to external components via one or more available wired or wireless communication links.

The exemplary system 500 may include a print command processing unit 560, which may be a part or a function of processor 520 coupled to, for example, one or more storage devices 530, or may be a separate stand-alone component module or circuit in the exemplary system 500. The print command processing unit 560 may review control and image data that specify an image forming operation to be carried out by the image forming device. The print command processing unit 560 may then control the image forming operation in the image forming device according to the control and image data, and particularly control heat levels in one or more processed image receiving media substrates output from the image forming device. Additionally, the print command processing unit 560 may provide for an automated or manual selection of a flow of individual sheets of image receiving media substrates exiting the outlet of the image forming device with which the exemplary system 500 is associated. The flow of the individual sheets of image receiving media exiting the outlet of the image forming device may be, for example, selectable between flowing the individual sheets of image receiving media substrates through a cooling and de-curling module to an output catch tray associated with the cooling and de-curling module or flowing the individual sheets of image receiving media substrates so as to bypass the cooling and de-curling module and proceed directly to the output catch tray.

All of the various components of the exemplary system 500, as depicted in FIG. 5, may be connected by one or more data/control busses 570. These data/control busses 570 may provide wired or wireless communication between the various components of the exemplary system 500, whether all of those components are housed integrally in, or are otherwise external and connected to, the exemplary system 500.

It should be appreciated that, although depicted in FIG. 5 as what appears to be an integral unit, the various disclosed elements of the exemplary system 500 may be arranged in any combination of sub-systems as individual components or combinations of components, integral to a single unit, or external to, and in wired or wireless communication with the single unit of the exemplary system 500. In other words, no specific configuration as an integral unit or as a support unit is to be implied by the depiction in FIG. 5. Further, although depicted as individual units for ease of understanding of the details provided in this disclosure regarding the exemplary system 500, it should be understood that the described functions of any of the individually-depicted components may be undertaken, for example, by one or more processors 520 connected to, and in communication with, one or more data storage devices 530.

Figure 6:
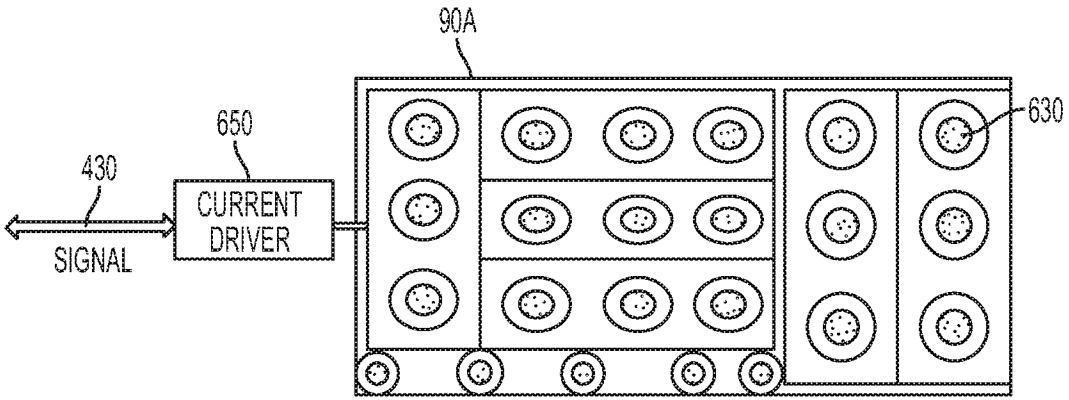
FIG. 6 shows a solid-state heater element capable of emitting high frequency field propagation in accordance to an embodiment.

FIG. 6 shows a solid-state heater element capable of emitting high frequency field propagation in accordance to an embodiment. Unless otherwise noted, elements similar to those previously described have been given the same reference numerals and serve the same functions. FIG. 6 illustrates a solid-state heater element with high frequency field propagation sources positioned in proximity to the at least one thermal conduction interface layer 310 and configured to conduct an electrical current. The heating element 90A can be configured with electronics that together with excitation coils 630 can form an excitation unit. The heating element 90A is located in thermal contact with the substrate portion of the receptor-laced fusing belt 210. The excitation coils 630 can have a varying coil density and can conduct electrical current produced from an excitation circuit like current driver 650 or any power supply capable of transmitting a current through the excitation coils 630. When the current driver 650 outputs a current through an excitation coil, a magnetic field is created in a region proximate to the excitation coil. The magnetic field can cause the induction of an eddy current and the generation of heat in the receptors at the top layer of fusing belt 210. The top layer can therefore dissipate heat resulting from the eddy current without any physical contact between the receptor-laced fusing belt and the excitation coils 630.

Figure 7:
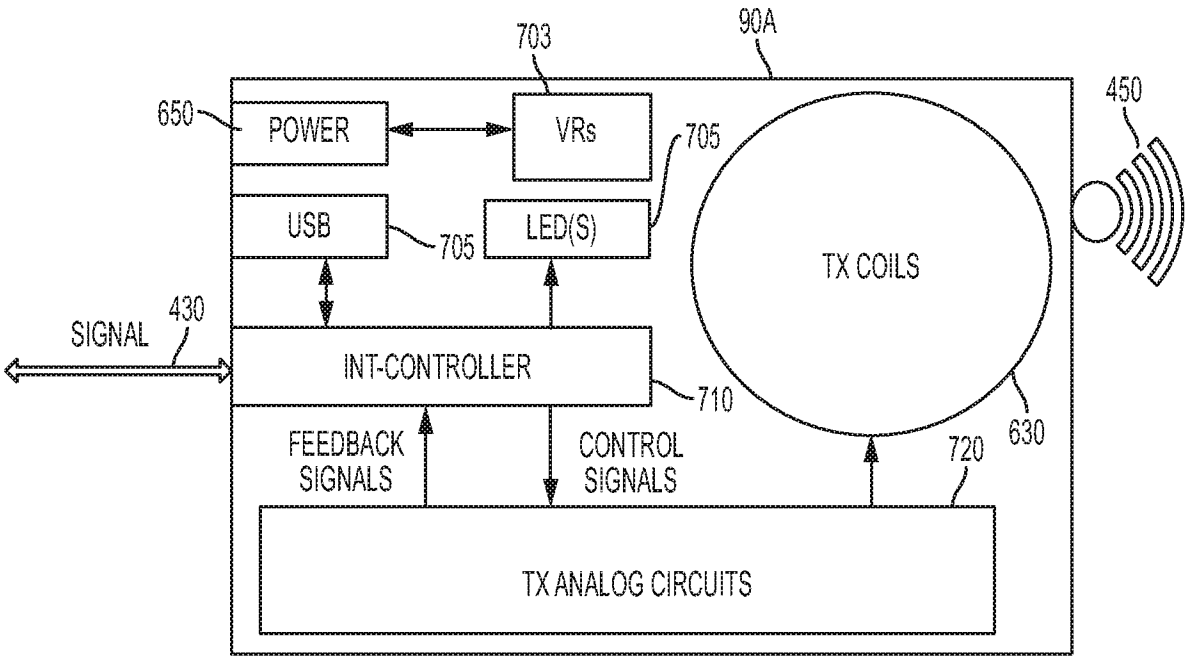
FIG. 7 shows the circuitry of a solid state heater in accordance to an embodiment.

FIG. 7 shows the circuitry of a solid state heater in accordance to an embodiment. Unless otherwise noted, elements similar to those previously described have been given the same reference numerals and serve the same functions.

FIG. 7 shows a simplified block diagram of wireless solid-state heater accordance to an embodiment. FIG. 7 illustrates an apparatus for wireless transmission of energy to cause heating at belt 210 directly on the top surface (receptors) bypassing thermal conduction interface 310. Input power such as from current driver 650 is provided to a transmitter 630 for generating a radiated field 450 for providing energy transfer to the receptors at fusing belt 210. The transmission coils at transmitter 630 can comprise coils of varying thickness and density, according to the systems and methods described herein. In embodiments, the current driver can be any component capable of generating a current and subsequent magnetic flux. The receptors 320 couple to the radiated field 450 and generates an output power in the form of heat for fusing the print substrate as it journeys through the nip 206. Any waste energy produced by the circuitry in solid-state heater 90A—coils, analog circuits, voltage regulators, and the like—is then transferred through the belt 210 via conduction. Transmitter 630 is housed in a solid state heater 90A that is proximate or in thermal contact with the fusing belt 210. Additionally, the solid-state heater may comprise one or more voltage regulator 703, internal controller or microcontroller 710 to control wireless power policies such duration and intensity of the transmitted energy, TXAnalog Circuits 720 such as power amplifiers, impedance matching, power sensing, input port and indicators like USB and LEDs 705, and other circuits known to those in the art. The transmit antenna is sized according to applications and devices to be associated therewith.

Figure 8:
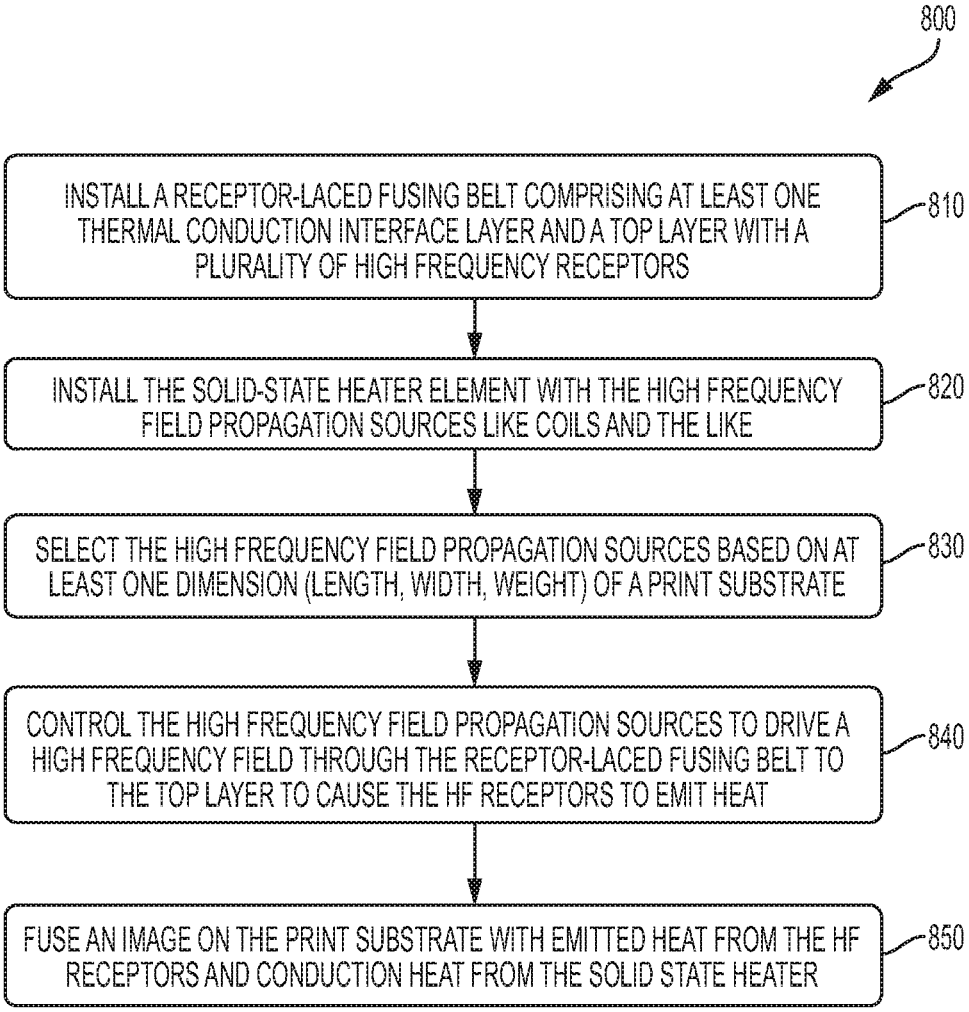
FIG. 8 is a flowchart illustrating high field propagation heating in accordance to an embodiment.

FIG. 8 is a flowchart 800 illustrating high field propagation heating in accordance to an embodiment. The disclosed embodiments may include an exemplary method for operating an image forming device with a particularly-configured cooling and de-curling module. FIG. 8 illustrates a flowchart of such an exemplary method. As shown in FIG. 8, operation of the method commences at action 810 and proceeds to action 820. In action 810, install a receptor-laced fusing belt comprising at least one thermal conduction interface layer and a top layer with a plurality of high frequency receptors. In action 820, install the solid-state heater element with the high frequency field propagation sources like coils and the like. In action 830, select the high frequency field propagation sources based on at least one dimension (length, width, weight) of a print substrate. In action 840, Control the high frequency field propagation sources to drive a high frequency field through the receptor-laced fusing belt to the top layer to cause the HF receptors to emit heat. In action 850, fuse an image on the print substrate with emitted heat from the HF receptors and conduction heat from the solid state heater.

Figure 9:
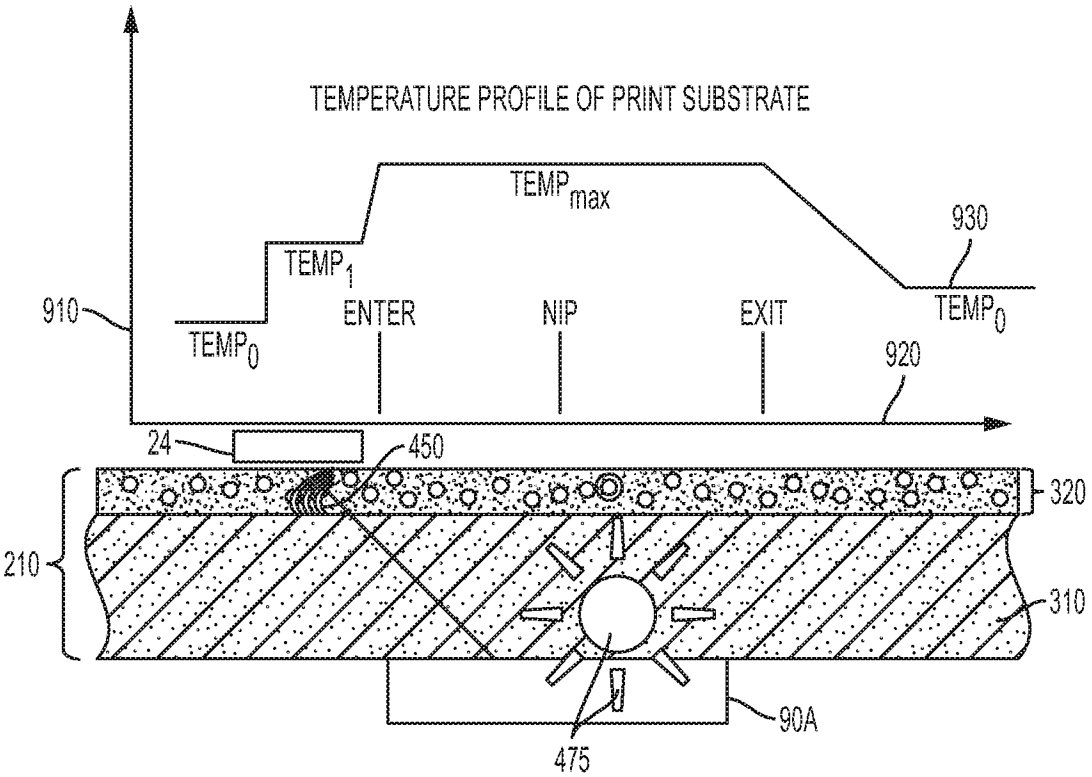
FIG. 9 is a temperature profile of a print substrate during fusing and high field propagation heating in accordance to an embodiment.

FIG. 9 shows a temperature profile 930 based on temperature levels 910 as the substrate travels 920 through the nip in accordance to an embodiment. As can be seen from the temperature profile 930 of a print substrate as it travels 920 through the nip created by the fusing and pressure rolls. The print substrate is an initial temperature, $Temp_0$. The initial temperature is then elevated, $Temp_1$ by the top layer of the receptor-laced fusing belt 210. The print substrate 24 is then heated directly (receptors 320) by the top layer bypassing thermal conduction interfaces 310 and is also simultaneously heated by conduction 475 from the waste energy of the heater element 90A to a maxim temperature ($Temp_{max}$).

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fusing system useful in printing comprising:

a fusing belt having a top layer laced with a plurality of high frequency receptors disposed over at least one thermal conduction interface layer, wherein the fusing belt is configured to contact at the top layer an image receiving substrate and fuse marking material deposited on the image receiving substrate;

wherein when an electrical current is applied to at least one of the plurality of high frequency receptors it causes heat to be generated at the top layer; and a solid-state heater element positioned in thermal contact with the at least one thermal conduction interface layer and comprising high frequency field propagation sources configured to generate the electrical current;

wherein residual heat as produced by circuitry in the solid-state heater is transferred to the top layer through the least one thermal conduction interface layer via conduction;

wherein the image receiving substrate is heated by the residual heat and the heat generated by the at least one of the plurality of high frequency receptors.

2. The system of claim 1, wherein the plurality of high frequency receptors are selected from a group consisting of carbon nanotubes, plasmonic particles, or any other electromagnetic absorbent material that can convert energy from the high frequency field propagation sources into heat, and wherein electromagnetic absorbent material can include iron powder, magnetite, and ferrite.

3. The system of claim 1, wherein the fusing belt is part of an outer surface of one or more of a fuser roll, a pressure roll, and a donor roll.

4. The system of claim 2, wherein the electrical current is generated from a power source connected to the high frequency field propagation sources.

5. The system of claim 4, wherein the high frequency field propagation sources comprise electrical coils.

6. The system of claim 2, wherein the carbon nanotubes comprise a sheet of a non-woven carbon nanotube textile.

7. The system of claim 6, wherein the sheet of the non-woven carbon nanotube textile comprises one or more of a single-, double-, or multi-walled carbon nanotube.

8. The system of claim 1, wherein the high frequency receptors comprise a highly magnetic, highly conductive material.

9. A method for inductively heating a fusing member useful in printing comprising:

providing a receptor-laced fusing belt configured to contact an image receiving substrate and fuse marking material deposited on the image receiving substrate;

wherein the receptor-laced fusing belt comprises at least one thermal conduction interface layer having a top layer with a plurality of high frequency receptors;

providing a solid-state heater element with high frequency field propagation sources positioned in thermal contact to the at least one thermal conduction interface layer and configured to generate an electrical current;

generating an electrical current through at least one of the high frequency field propagation sources;

inductively heating the top layer with the plurality of high frequency receptors via the generated electrical current;

wherein residual heat in the solid-state heater element is transferred to the top layer through the at least one thermal conduction interface layer;

wherein the image receiving substrate is heated by the residual heat and the heat generated by the at least one of the plurality of high frequency receptors; and moving the heated top layer to fuse marking material deposited on the image receiving substrate.

10. The method of claim 9, wherein the plurality of high frequency receptors are magnetic material formed as particles such as nanostructures that is not particularly limited and may be suitably selected from magnetic materials that can convert energy from the high frequency field propagation sources into heat.

11. The method of claim 9, wherein the receptor-laced fusing belt is part of an outer surface of one or more of a fuser roll, a pressure roll, and a donor roll.

12. The method of claim 10, wherein the electrical current is generated from a power source connected to the high frequency field propagation sources.

13. The method of claim 12, wherein the high frequency field propagation sources comprise electrical coils.

14. The method of claim 10, wherein the nanostructures comprise a sheet of a non-woven carbon nanotube textile.

15. The method of claim 14, wherein the sheet of the non-woven carbon nanotube textile comprises one or more of a single-, double-, or multi-walled carbon nanotube.

16. The method of claim 9, wherein the high frequency receptors comprise a highly magnetic, highly conductive material.

17. At least one machine-readable medium comprising a plurality of instructions, when executed on a computing device, to implement or perform a method as claimed in claim 9.

18. The non-transitory computer-readable medium storing computer-readable instructions according to claim 17, wherein the plurality of high frequency receptors are selected from a group consisting of carbon nanotubes, plasmonic particles, or any other electromagnetic absorbent material that can convert energy from the high frequency field propagation sources into heat; and wherein residual heat in the solid-state heater element is transferred to the top layer through the at least one thermal conduction interface layer.

* * * * *